United States Patent [19]

Warren et al.

[11] Patent Number: 4,863,566

[45] Date of Patent: Sep. 5, 1989

[54] PROCESS FOR THE PRESERVATION OF PRINTED CELLULOSIC MATERIALS

[76] Inventors: Morris J. Warren, 3615 Majestic La., Bowie, Md. 20715; Michael L. Howe, 41 Valley Crest, Annandale, N.J. 08801

[21] Appl. No.: 186,454

[22] Filed: Apr. 26, 1988

[51] Int. Cl.[4] ..... D21H 5/22

[52] U.S. Cl. ..... 162/160; 162/182; 422/1; 422/32; 422/34; 422/37

[58] Field of Search ..... 422/1, 32, 34, 37; 162/160, 182, 135, 158; 252/380; 427/255.3, 395

[56] References Cited

U.S. PATENT DOCUMENTS 3,472,611 10/1969 Langwell ..... 427/395

3,676,055 7/1972 Smith ..... 427/395

3,703,353 11/1972 Kusterer et al. ..... 162/160

FOREIGN PATENT DOCUMENTS 2434473 1/1976 Fed. Rep. of Germany ..... 422/34

*Primary Examiner*—Peter Chin

*Attorney, Agent, or Firm*—Edmund M. Jaskiewicz

[57] ABSTRACT

A process and composition for use in the deacidification of cellulosic materials, such as books and printed papers, which comprises treating the materials under vacuum condition with a gaseous mixture of ammonia, and an organo epoxide reagent selected from the group consisting of alkyl compounds or mixtures thereof, and which produce in situ primary, secondary and tertiary amino compounds upon reaction with the ammonia.

8 Claims, No Drawings

PROCESS FOR THE PRESERVATION OF PRINTED CELLULOSIC MATERIALS

The present invention relates to the preservation of printed cellulosic materials, more particularly to a process for the deacidification of books, manuscripts and other documents by gaseous treatment.

A serious problem throughout the world is the preservation of cellulosic materials, particularly printed cellulosic materials such as books, manuscripts and documents. Large quantities of these materials have deteriorated to such an extent that they can be used only under restricted conditions. The problem is not limited to isolated instances of the deterioration of individual examples of rare and ancient documents, but alarmingly threatens substantial portions of library collections. Libraries and others are greatly concerned about the deterioration of these valuable cellulosic materials, and their losses of virtually irreplaceable records are already very large.

The great bulk of present day library collections dates from the development and use of wood pulp as a source of cellulose fibers for paper, and the general acceptance of alum and rosin in the sizing step for the mass production of paper.

Paper made from untreated wood pulp is too absorbent to allow sharp image imprint. Therefore, chemicals have to be added to the wood fibers during processing. These additives allow the paper to accept inks and dyes and increase paper opacity. Unfortunately, most of these chemicals are either acidic or are deposited by acidic mechanisms which initiate the slow, relentless acidic deterioration of paper.

Not only does the use of alum contribute to the acidity of paper and its subsequently accelerated deterioration, but conventional wood pulping processes may also degrade and/or oxidize the cellulose fibers or may not remove all unstable non-cellulosic materials from the wood. Accordingly, much of these library collections are printed on acidic paper with poor aging characteristics, and in terms of their permanency lifetimes, have reached old age or are rapidly approaching it.

Other contributions to the acidification of paper are made by man through industrial emissions of sulphur and nitrogen and carbon oxides or by natural processes such as sea salt spray. Even books or paper of neutral and alkaline character are not immune. As neighboring papers of acidic nature degrade, volatile acids are produced which either diffuse through adjoining books or permeate the atmosphere and may ultimately acidify even the "safe or stable" books.

In order to arrest this acidic degradation, paper materials must be deacidified and provided with an alkaline reserve or buffer to retard a return to an acidic state. Currently, there are several processes either in various stages of development or commercialization for deacidifying paper whether bound or unbound. Numbering among these are processes using volatile metal alkyls e.g. U.S. Pat. Nos. 3,969,549 and 4,051,276 and volatile amines e.g. U.S. Pat. Nos. 3,472,611, 3,771,958 and 3,703,353. U.S. Pat. No. 3,676,182 issued July 11, 1972 describes the treatment of cellulosic materials with alkali and alkaline earth bicarbonates, carbonates, and hydroxides (Col. 17) in a halogenated hydrocarbon solvent or lower aliphatic hydrocarbon such as n-butane (Col. 7).

In the process for preserving cellulosic materials as described in U.S. Pat. No. 3,676,055, the cellulosic material is initially contacted with a deacidification solution comprising an alkali or alkaline earth agent, e.g. magnesium alkoxide, and after removal of the solvent solution, the resultant material is contacted with alkylene oxide gas, e.g. ethylene oxide.

Canadian Pat. No. 911,110 issued Oct. 3, 1982 to Smith describes a deacidification solution (p. 5) of 7% magnesium methoxide solution in methanol (10 parts) and a halogenated solvent or solvents (90 parts); and states that a magnesium alkoxide reacts with water in paper to form a midly alkaline milk of magnesia, being magnesium hydroxide (p. 31). Improved results are reported with the use of the halogenated hydrocarbon solvents (p. 40).

U.S. Pat. No. 3,969,549 describes a method of deacidifying paper wherein the paper is exposed to the vapors of a volatile organo-metallic compound, such as diethyl zinc, and subsequently introducing a reacting agent, such as water vapor or ammonia to hydrolyze the zinc compound and deposit alkaline zinc as zinc oxide in the paper. U.S. Pat. No. 4,051,276, a division of the earlier patent relates to alike process wherein solutions of selected organimetallic compounds dissolved in an organic solvent are utilized for deacidifying a cellulose fiber paper. Such processes, however, comprising the deposition of alkaline metal compounds of the metal constituent of the organometallic compounds, tend to produce uneven deposits. Furthermore, complete penetration of the pages of closed stacked books are difficult to achieve. In addition to these disadvantages, processes utilizing diethyl zinc, etc., are extremely flammable and may bring about an explosion in the presence of air. Moreover, such processes are highly toxic.

Unfortunately, all of these processes suffer from one or more of a number of drawbacks that have prevented their wide-spread acceptance. These drawbacks include high cost, toxicity, complexity of treatment, residual odor, deleterious effects on certain types of paper and inks, lack of an alkaline reserve, and the necessity of drying the book or paper to very low misture contents before treatment.

Despite the seriousness of the problem, and the extensive effort toward solving it, a satisfactory solution to the problem of deacidification and long term preservation of cellulosic materials,and particularly a solution which is not harmful to the paper, pigments or media of printed materials, has not been found.

There is a present and serious need for a proper method to effect preservation of cellulosic materials so that old books, manuscripts, works of art, and valuable papers may be preserved. Such a process which would be capable of mass, as well as individual treatment of cellulosic materials, including treatment of whole books, is not only desirable, but necessary for the economical preservation of the large quantities of cellulosic materials which are presently deteriorating.

It is therefore, the principal object of the present invention to provide a novel and improved process for the preservation of books, manuscripts and other documents.

It is another object of the present invention to provide such a process for the mass deacidification of books and other printed materials.

It is an additional object of this invention to preserve cellulosic materials which are printed without destroying or impairing the fidelity of the printed material.

It is a still further object of this invention to provide means for preserving cellulosic materials for extended periods of time.

The present invention provides a new, safe process and composition for neutralizing the normal acid found in books and papers, and produces a residual alkaline potential which maintains alkalinity to aid in preserving a book or document against the condition usually called "aging". An additional benefit of this process is the deinfestation of the paper from mold, bacteria, insects and other organisms.

Whereas all types of paper become more fragile over time, the rate of deterioration increases markedly with acid content. Embrittlement is most pronounced in books and papers produced from wood pulp which is acidic. The aging of paper is generally attributed to the presence of carboxyl groups (COOH) present naturally in paper, particularly in cellulose derived from wood pulp, as aforementioned and acidic groups such as are found in the alum sizing (and other sizing) and fillers used in making paper. Tests have shown that if the acidic groups can be neutralized, the aging of paper can be greatly retarded. This is important to the preservation of important books and documents.

Almost all sizings tend to make the paper acid with the alum sizing being one of the offenders and the cause of the rapid deterioration of paper since its use began in the early 1800s. This sizing acidity would also be neutralized by the procedure outlined below. Furthermore, a residual alkalinity in the form of a primary, secondary or tertiary amine (or the ethanol amines of each) would be formed.

In regard to the use of ethylene oxide (whether as 100% or mixed with inert gases such as freon, nitrogen or carbon dioxide), such gaseous mixtures have been used for years to fumigate and deinfestate books and documents. But no attempt has been made to use the high vacuum process of ethylene oxide sterilization to neutralize the acid groups (carboxyl etc.) in the paper with ethylene oxide.

Ethylene oxide, however, is used extensively to modify starch and cellulose, the former usually using a sodium hydroxide catalyst in a water dispersion. The "modification: usually involves the addition of ethylene oxide on to the large number of carboxyl (acid) groups that tend to make paper acid. This addition is essentially an esterification reaction commonly used to make emulsifiers and it neutralizes the carboxylic group so that it is no longer acid, but offers no reserve alkalinity.

The Invention

It has been unexpectedly discovered that a very effective and simplified method of deacidification of books, papers and the like, is achieved by forming a primary, secondary and tertiary amine in situ in the papers to be treated. Thus, the use of organo-metallic compounds and deposition of the metal constituent as has been deemed necessary in prior art processes is entirely eliminated.

Method Steps

The process of the present invention comprises the following steps for the treatment of cellulosic material to preserve the same against deterioration through aging:

Initially, placing the material to be treated in an airtight chamber and evacuating the chamber; injecting anhydrous ammonia gas into the chamber, and water vapor, such as steam, and then introducing an organo reagent, e.g. ethylene oxide, or the like, e.g. propylene or butylene oxide in vapor form into the evacuated chamber and which gaseous mixture therein reacts with the ammonia to produce the amino compounds as aforementioned. Preferably, the ammonia is introduced in gaseous form, but, if desired it may be in the form of a solution (e.g. $NH_4OH$) and from which gaseous $NH_3$ will be released under the reaction pressure present in the treatment chamber.

The method or procedure produces an amine compound in situ on the paper being treated. Such amine then functions as a catalyst causing the ethylene oxide or the like, as aforementioned, to react with the carboxyl groups in the cellulose and other acidic groups in the paper, coating and sizing. Gaseous ammonia does not react with ethylene oxide unless there is moisture present, then the reaction will take place forming primary, secondary, and tertiary amines. These amines, which are formed in situ, provide a catalyst and cause the oxide to react with the cellulose and paper coating as described. It, of course, will be appreciated that the sequence of additions may be changed, when desired, e.g. the ethylene oxide (whether in gaseous or liquid form) may be introduced first, or at the same time as the ammonia and water vapor (or steam).

The present process or procedure has been developed on the basis of an established set of industrial processes for mass treatment of various materials (including medical products and food ingredients) in large-scale vessels to demanding standards specific to the materials being treated. The particular strength of the process derives from its fundamental and original approach, that of developing an industrial process ab initio, rather than attempting to adapt a process suitable for treatment of individual documents or paper sheets (book pages) to the stringent demands of mass book deacidification and preservation.

Process development with the use of a large-scale vessel allowed the avoidance of problems usually associated with scaling up to industrial production levels. Books can be prepackaged into sealed boxes and handled in a palletized fashion. Process testing was done on books with various covers, papers, and inks, and on standard papers treated in a stack form.

The present process is a multi-stage gaseous-phase mass treatment process. It is based on permanent modification of the cellulose backbone structure, rather than on deposition of a basic material within the book pages. The process allows specific selection of pH values between 7.0 and approximately 11.0. However, it is recognized that high alkalinity may be equally damaging to a book as high acidity.

The process has been therefore, designed to raise the pH level of the treated materials into the desirable 7.0–11.0 pH range, with sufficient residual alkaline buffer to compensate for acid production over the very long projected life time of the treated books. The process affords excellent penetration throughout the book and even treatment across book pages. The pH increase is stable. Further, the inventive process is readily controlled to provide a specific pH range, for example, such as a pH of 7–8, 8–9 or 9–10 as desired.

Accelerated aging tests, performed in accordance with the appropriate TAPPI (Trade Association of the Paper and Pulp Industry) standards, have shown an impressive retention of folding endurance by treated paper. Hundreds of years of usable life may be projected based on the results obtained.

No organo-metallic compounds are utilized in the treatment, and no deleterious effect on any type of ink or paper has been observed. Virtually no residual odor or color change in treated books using the invention is perceptible; and all the process steps are safe.

The following Examples illustrate how the invention may be practiced:

EXAMPLE 1

Books of printed matter being treated are placed within a corrugated box and the box sealed with packing tape. Then this boxed material is stacked inside the treating chamber and the door thereto closed and sealed; and the chamber evacuated. Thereafter, the relative humidity is adjusted to 50% RH by addition of steam. Ammonia ($NH_3$) is then introduced in an amount sufficient to react with the ethylene oxide concentration. The material being treated is held in the presence of ammonia and steam for four hours at a temperature of 40 deg. C. Following this, ethylene oxide gas is passed through a volatilizer and into the chamber to a concentration of 0.6 oz/$FT^3$. The material in the chamber is then held in the presence of the ammonia, water vapor and ethylene oxide mixture for 24 hours at a temperature of 40 deg. C. At the end of the exposure period a vacuum is drawn to 28" Hg. Ambient air is then allowed to enter the chamber until the pressure inside the chamber equals the ambient. Thereafter, the chamber door is opened and the treated material removed. Results are shown below.

| Book # | pH | |
|---|---|---|
| | Before Treatment | After Treatment |
| 1 | 4.60 | 8.65 |
| 2 | 5.25 | 8.50 |
| 3 | 7.25 | 8.70 |
| 4 | 6.60 | 8.55 |
| 5 | 6.65 | 8.55 |
| 6 | 5.70 | 8.75 |

In the foregoing Example 1, the parameters of procedure for deacidification of books were as follows:

| | Nominal | Range |
|---|---|---|
| Exposure Temperature | 40 deg. C. | 20 deg. C.–90 deg. C. |
| Exposure time | 24 hr. | 1 hr.–48 hr. |
| Vacuum Level | 28" Hg | 0"–29" Hg |
| Ethylene Oxide Concentration | 0.6 oz/$FT^3$ | 0.1 oz/$FT^3$–2.0 oz/$FT^3$ |
| Ammonia Concentration | 10 ml of 9% Aqueous/$FT^3$ | 5–50 ml/$FT^3$ |
| Water Vapor Concentration | 50% RH | 10%–90% RH |

The chamber size utilized can be varied to accomodate the volume of books to be treated. The process has been successfully demonstrated in 200 $FT^3$, 1000 $FT^3$, and 6000 $FT^3$ chambers. Materials may be enclosed in any containers which permit free exchange of gaseous elements with the atmosphere within the treatment chamber. The process has been successfully demonstrated using corrugated cartons sealed with packing tape. Individual books have also been successfully treated when enclosed in sealed plastic pouches commonly used for sterilization of medical supplies. Materials to be treated may be arranged, within the boxes in any fashion which maximizes packing. Specifically, no special arrangement of materials is required to facilitate penetration of treatment gases.

In the processing of books, papers, and the like, the reagent used to react with the ammonia may comprise two alkene oxide gas mixtures e.g. 12% ethylene oxide in Freon and 8% propylene oxide in $CO^2$. The two gases have been found to be equally effective in deacidification of books, etc. Further, a mixture of 10% ethylene oxide and 90% carbon dioxide may be used. This mixture is also nonflammable. Other mixtures of these two gases may be utilized as desired.

EXAMPLE 2

Books were treated as described in Example 1 except that propylene oxide (PO) was substituted for ethylene oxide. The concentration of PO in this experiment was 1.0 oz/$FT^3$. Results are shown below.

| Book # | pH | |
|---|---|---|
| | Before Treatment | After Treatment |
| 1 | 6.35 | 8.35 |
| 2 | 5.85 | 8.35 |
| 3 | 7.00 | 8.70 |
| 4 | 6.20 | 8.20 |
| 5 | 6.75 | 8.65 |

EXAMPLE 3

Books were treated as described in Example 1 except that the exposure time was increased from 24 hours to 46 hours. Results are shown below.

| Book # | pH | |
|---|---|---|
| | Before Treatment | After Treatment |
| 1 | 4.75 | 8.35 |
| 2 | 6.60 | 8.90 |
| 3 | 5.80 | 8.65 |
| 4 | 5.95 | 8.60 |
| 5 | 6.35 | 8.95 |
| 6 | 6.20 | 8.90 |

EXAMPLE 4

The materials in this case were treated as described in Example 1, and wherein the reagent comprised a gaseous mixture of ethylene oxide and propylene oxide. Liquid mixtures in gaseous form may be used when desired.

EXAMPLE 5

The materials in this instance were treated as described in Example 1, except the reagent comprised a mixture of Freon, propylene oxide and carbon dioxide.

EXAMPLE 6

The cellulosic material was treated as described in Example 1 except that the reagent comprised a suitable gaseous mixture of ethylene oxide, propylene oxide and carbon dioxide.

The following tables present some of the results obtained in the application of the process.

1. Effect Of Treatment On pH Of Various Books

| Book | pH Before Treatment | After Treatment | Change |
|---|---|---|---|
| 1 | 9.20 | 9.60 | 0.40 |
| 2 | 5.25 | 8.40 | 3.15 |
| 3 | 7.20 | 8.95 | 1.75 |
| 4 | 8.00 | 8.90 | 0.90 |
| 5 | 6.15 | 8.30 | 2.15 |

2. pH Change In Various Types Of Paper Following Treatment

| Paper | pH Before Treatment | After Treatment | Change |
|---|---|---|---|
| 20 lb. Offset (IPCo.) | 9.45 | 9.85 | 0.40 |
| 60 lb. Bond | 6.65 | 8.35 | 1.70 |
| Cross-Section Pad (Morilla Co.) | 6.25 | 8.00 | 1.75 |
| Note Pad | 5.95 | 8.20 | 2.25 |

UNIFORMITY OF PENETRATION IN TREATMENT BY THIS PROCESS 3. pH Distribution Across Single Pages of Treated Books

| Book | pH Outer Edge | Center | Inner Edge |
|---|---|---|---|
| 1 | 8.40 | 8.45 | 8.45 |
| 2 | 8.85 | 8.75 | 8.85 |
| 3 | 8.30 | 8.30 | 8.35 |
| 4 | 8.35 | 8.25 | 8.35 |

4. pH Distribution Among Different Pages Within Treated Books

| Book | pH Front | Center | Back |
|---|---|---|---|
| 1 | 8.10 | 8.15 | 8.15 |
| 2 | 8.30 | 8.35 | 8.35 |
| 3 | 8.60 | 8.65 | 8.70 |
| 4 | 8.30 | 8.35 | 8.30 |

STABILITY OF TREATMENT BY THIS PROCESS

5. Stability of pH Change Following Treatment

| Book | pH day 1 | day 14 | day 40 |
|---|---|---|---|
| 1 | 9.60 | 9.55 | 9.55 |
| 2 | 8.40 | 8.30 | 8.35 |
| 3 | 8.95 | 8.90 | 8.75 |
| 4 | 8.90 | 8.90 | 8.85 |
| 5 | 8.30 | 8.25 | 8.25 |

ACCELERATED AGING TESTS FOLLOWING TREATMENT

6. Effect of Accelerated Aging at 100 deg. C. On pH of Various Types of Paper

| Paper | Deacidification Treatment | pH 7 days | 12 days | 21 days | 33 days |
|---|---|---|---|---|---|
| 20 lb. Offset | – | 9.05 | 8.45 | 6.75 | 6.75 |
| 20 lb. Offset | + | 9.55 | 8.95 | 8.85 | 8.65 |

-continued

6. Effect of Accelerated Aging at 100 deg. C. On pH of Various Types of Paper

| Paper | Deacidification Treatment | pH 7 days | 12 days | 21 days | 33 days |
|---|---|---|---|---|---|
| 60 lb. Bond | – | 6.40 | 6.00 | 5.65 | 4.95 |
| 60 lb. Bond | + | 8.35 | 7.75 | 7.10 | 6.40 |
| Cross-Section Pad | – | 6.20 | 5.85 | 5.60 | 5.45 |
| Cross-Section Pad | + | 7.60 | 7.35 | 6.55 | 6.10 |
| Note Pad | – | 5.80 | 5.45 | 5.30 | 4.70 |
| Note Pad | + | 7.05 | 6.40 | 6.00 | 5.65 |

7. Effect Of Accelerated Aging at 100° C. On Folding Strength Of Various Types of Paper

| Paper | Treatment | Folding Endurance 7 days | 12 days | 21 days | 33 days |
|---|---|---|---|---|---|
| 20 lb. Offset | – | 351 | 243 | 132 | 92 |
| 20 lb. Offset | + | 345 | 312 | 284 | 136 |
| 60 lb. Bond | – | 195 | 169 | 54 | 49 |
| 60 lb. Bond | + | 190 | 216 | 112 | 127 |
| Cross-Section Pad | – | 214 | 111 | 54 | 37 |
| Cross-Section Pad | + | 260 | 125 | 120 | 82 |
| Note Pad | – | 103 | 35 | 13 | 11 |
| Note Pad | + | 127 | 83 | 50 | 42 |

8. Effect of Accelerated Aging at 100° C. on Folding Strength of Various Books

| Book | Treatment | pH day 0 | Folding Endurance 7 days | 13 days | 28 days |
|---|---|---|---|---|---|
| 1 | – | 6.55 | 101 | 74 | 19 |
| 1 | + | 8.40 | 158 | 106 | 42 |
| 2 | – | 7.25 | 183 | 150 | 39 |
| 2 | + | 8.85 | 307 | 262 | 92 |

It will be understood that this invention is susceptible to modification in order to adapt it to different usages and conditions, and accordingly, it is desired to comprehend such modifications within this invention as may fall within the scope of the appended claims.

What is claimed is:

1. In a process for the treatment of cellulosic material to preserve the cellulosic material against deterioration through aging, the steps of placing the cellulosic material to be treated in airtight chamber and evacuating the chamber, injecting ammonia into the evacuated chamber to penetrate the cellulosic material, introducing water vapor into the evacuated chamber, and introducing an alkene oxide reagent into the evacuated chamber which reacts to produce primary, secondary, and tertiary amines in situ.

2. A process as claimed in claim 1, wherein the reagent is gaseous ethylene oxide.

3. A process as claimed in claim 1, wherein the reagent is gaseous propylene oxide.

4. A process as claimed in claim 1, wherein the reagent is a mixture of gaseous ethylene oxide and propylene oxide.

5. A process as claimed in claim 1 wherein the reagent oomprises a gaseous mixture of ethylene oxide and carbon dioxide.

6. A process as claimed in claim 1 wherein the reagent comprises a gaseous mixture of ethylene oxide, carbon dioxide and butylene oxide.

7. A process as claimed in claim 1 wherein the ammonia is in the form of a solution comprising $NH_4OH$.

8. A process as claimed in claim 1 wherein the amines in situ comprise alkanolamines.

* * * * *